US012447378B2

(12) United States Patent
Belsham et al.

(10) Patent No.: US 12,447,378 B2
(45) Date of Patent: Oct. 21, 2025

(54) EXERCISE DEVICE

(71) Applicant: F&P TECH FITNESS LIMITED, Auckland (NZ)

(72) Inventors: Anthony John Belsham, Hamilton (NZ); Ty Elgin Andrews, Hamilton (NZ)

(73) Assignee: F&P TECH FITNESS LIMITED, Auckland (NZ)

( * ) Notice: Subject to any disclaimer, the term of this patent is extended or adjusted under 35 U.S.C. 154(b) by 100 days.

(21) Appl. No.: 18/036,302

(22) PCT Filed: Nov. 9, 2021

(86) PCT No.: PCT/NZ2021/050197
§ 371 (c)(1),
(2) Date: May 10, 2023

(87) PCT Pub. No.: WO2022/103278
PCT Pub. Date: May 19, 2022

(65) Prior Publication Data

US 2023/0405404 A1 Dec. 21, 2023

(30) Foreign Application Priority Data

Nov. 11, 2020 (NZ) ..... 769852
Aug. 24, 2021 (AU) ..... 2021221521

(51) Int. Cl.
*A63B 24/00* (2006.01)
*A63B 21/00* (2006.01)
(Continued)

(52) U.S. Cl.
CPC ..... *A63B 24/0075* (2013.01); *A63B 21/0058* (2013.01); *A63B 21/153* (2013.01);
(Continued)

(58) Field of Classification Search
CPC ..... A63B 24/0075; A63B 21/0058; A63B 21/153; A63B 21/4035; A63B 2024/0068;
(Continued)

(56) References Cited

U.S. PATENT DOCUMENTS 8,360,935 B2 1/2013 Olsen et al.
8,845,499 B1 9/2014 Boatwright
(Continued)

FOREIGN PATENT DOCUMENTS

EP 3221015 B1 1/2019
WO 2009/074942 A1 6/2009
(Continued)

OTHER PUBLICATIONS

Extended European Search Report for European Patent Application No. 21892422.3 dated Sep. 10, 2024.

*Primary Examiner* — Sundhara M Ganesan
(74) *Attorney, Agent, or Firm* — Clark Hill PLC; James R. Foley

(57) ABSTRACT

A personal exercise device comprises a user interface to be moved by a user in a 3-dimensional space when using the device, a resistance mechanism to generate a force, a cable coupled between the user interface and the resistance mechanism to transmit the force from the resistance mechanism to the user interface, one or more sensors configured to detect movement of the user in the 3-dimensional space when using the device, a feedback device; and a controller in communication with the one or more sensors. The controller is configured to estimate a user specific body structure for the user, determine a user specific target movement for the user based on the user's body structure, determine an actual movement of the user when using the device to perform an exercise based on one or more outputs from the one or more sensors, and provide feedback to the user via the
(Continued)

feedback device based on a comparison between the user's actual movement and the user specific target movement.

21 Claims, 8 Drawing Sheets

(51) Int. Cl.
*A63B 21/005* (2006.01)
*A63B 71/06* (2006.01)

(52) U.S. Cl.
CPC .. *A63B 21/4035* (2015.10); *A63B 2024/0068* (2013.01); *A63B 2024/0093* (2013.01); *A63B 2024/0096* (2013.01); *A63B 2071/0625* (2013.01); *A63B 2071/0636* (2013.01); *A63B 2208/0204* (2013.01); *A63B 2220/13* (2013.01); *A63B 2220/20* (2013.01); *A63B 2220/52* (2013.01); *A63B 2220/833* (2013.01); *A63B 2225/02* (2013.01); *A63B 2230/01* (2013.01)

(58) Field of Classification Search
CPC .... A63B 2024/0093; A63B 2024/0096; A63B 2071/0625; A63B 2071/0636; A63B 2208/0204; A63B 2220/13; A63B 2220/20; A63B 2220/52; A63B 2220/833; A63B 2225/02; A63B 2230/01; A63B 21/4043; A63B 24/0006; A63B 71/0622; A63B 2225/20; A63B 21/152; A63B 24/0003; A63B 71/0619
See application file for complete search history.

(56) References Cited

U.S. PATENT DOCUMENTS

| | | | | |
|---|---|---|---|---|
| 9,101,791 | B2 | 8/2015 | Boyette | |
| 9,272,186 | B2 | 3/2016 | Reich et al. | |
| 9,409,053 | B1 | 8/2016 | Todd | |
| 10,118,073 | B2 | 11/2018 | Wicks et al. | |
| 2015/0343266 | A1* | 12/2015 | Vardy | A61B 5/1036 482/8 |
| 2016/0166880 | A1 | 6/2016 | Nakajima | |
| 2018/0214729 | A1 | 8/2018 | Rubin et al. | |
| 2018/0296879 | A1* | 10/2018 | Blium | A63B 21/0615 |
| 2019/0344123 | A1 | 11/2019 | Rubin et al. | |
| 2020/0047027 | A1 | 2/2020 | Ward et al. | |
| 2020/0047031 | A1 | 2/2020 | Orady et al. | |
| 2020/0054929 | A1 | 2/2020 | Ward et al. | |

FOREIGN PATENT DOCUMENTS

| | | | |
|---|---|---|---|
| WO | 2014/040660 | A1 | 3/2014 |
| WO | 2015/011482 | A1 | 1/2015 |
| WO | 2019/100117 | A1 | 5/2019 |
| WO | 2021/046596 | A1 | 3/2021 |

* cited by examiner

EXERCISE DEVICE

This application is a National Phase Filing of PCT/NZ2021/050197, having an International filing date of Nov. 9, 2021, which claims priority of NZ 769852, filed Nov. 11, 2020, and AU 2021221521, filed Aug. 24, 2021. The disclosure of the foregoing are hereby incorporated by reference.

STATEMENT OF CORRESPONDING APPLICATIONS

This application is based on the specifications filed in relation to New Zealand Patent Application Number 769852 and Australian patent Application Number 2021221521, the entire contents of which are incorporated herein by reference.

FIELD OF INVENTION

The invention generally relates to the field of exercise devices that employ a user interface attached to a resistance mechanism via a cable to provide resistance training exercises to a user, and also to a device and method for providing feedback to a user when exercising.

BACKGROUND TO THE INVENTION

Exercise equipment or devices for providing resistance-based exercises or training to a user traditionally include weights in the form of metal plates. Such exercise devices include a frame for movably supporting the plates, and a handle or bar or other user interface connected to the plates via a cable and pulley system for lifting the plates. A mechanism allows the user to select a desired number of plates in a stack and therefore weight to be lifted via the handle and cable to perform a weightlifting exercise.

Technological developments in areas such as electrical motor technology, display screen technology and digital camera technology have driven development of resistance-based exercise equipment that provides resistance training or exercise to a user via an electrically driven resistance mechanism. The electrically driven resistance mechanism (such as an electric motor/generator) may be controlled in a way to provide a resistance or force to the user that replicates a traditional stack of metal plates, to allow the user to perform familiar weight training exercises previously performed using traditional mechanical weight-based equipment.

One such example of an electrically driven resistance training device is the Tonal™ home gym.

One drawback of electrically driven resistance training devices is that they can be expensive. Devices may include one or more cameras to monitor the user, and a large display screen to present video or other visual information to the user, adding significant cost to the device. Cameras and screens may be required to monitor user performance and present performance or training feedback information to the user. Such devices may also require connection with a remotely located person (a personal trainer) via a communications network to provide feedback to the user during training.

While electrically driven resistance training devices may be much smaller and lighter than traditional mechanical metal plate systems, some electrical resistance-based exercise devices may not be portable, easily transported or moved. For example, such systems may be configured predominantly for indoor use, and/or may not be suitable for transporting from a home environment for use at an alternative venue such as a community gym, or in an outside environment such as park grounds or gardens.

SUMMARY OF THE INVENTION

It is an object of the invention to provide an exercise device that addresses one or more of the above-mentioned problems, and/or to provide the public with a useful choice.

According to a first aspect of the invention, the present invention provides an exercise device comprising:

- a user interface to be moved by a user in a 3-dimensional space when using the device;
- a resistance mechanism to generate a force;
- a cable coupled between the user interface and the resistance mechanism to transmit the force from the resistance mechanism to the user interface;
- one or more sensors configured to detect movement of the user in the 3-dimensional space when using the device;
- a feedback device; and
- a controller in communication with the one or more sensors, the controller configured to:
  - estimate a user specific body structure for the user (the user's body structure);
  - determine a user specific target movement for the user based on the user's body structure;
  - determine an actual movement of the user when using the device to perform an exercise based on one or more outputs from the one or more sensors; and
  - provide coaching feedback to the user via the feedback device based on a comparison between the user's actual movement and the user specific target movement.

In some embodiments, the controller is configured to determine a plurality of user specific target movements based on the estimated user's body structure, wherein each target movement corresponds to one exercise of a plurality of exercises to be performed when using the device.

In some embodiments, the controller is configured to determine one or more than one target movement for each exercise in a plurality of exercises.

In some embodiments, the target movement corresponds with the user interface and/or a joint of the user's body.

In some embodiments, the user's body structure is defined by the relative positions of a part of the user's body associated with the user interface (e.g. the user's hand) and one or more other parts of the user's body.

In some embodiments, the one or more other parts of the user's body is one or more joints of the user's body. In a preferred embodiment, the user's body structure is defined by the relative positions of the user's hands and one or more of the following joints: ankles, knees, hips, shoulders, elbows and wrists. In a most preferred embodiment, the user's body structure is defined by the relative positions of the user's hands/user interface and at least the following joints: knees, hips, shoulders and elbows.

In some embodiments, the controller is configured to estimate the user's body structure based on one or more user specific body dimensions.

In some embodiments, the controller is configured to estimate the user's body structure based on the one or more user specific body dimensions and a predetermined reference body structure.

In some embodiments, the device comprises a memory in communication with the controller for storing a plurality of reference body structures, and the controller is configured to select the reference body structure from the plurality of reference body structures based on user inputs.

In some embodiments, the user's body structure is estimated by scaling body dimensions of the reference body structure based on the user's body dimensions.

In some embodiments, the user specific body dimensions include one or more of the user's height, shoulder height, arm length, torso length, leg length, shoulder width or hip width.

In some embodiments, the user's body structure is based on the user's arm length, leg length and shoulder height and/or torso length.

In some embodiments, the one or more sensors is configured to provide one or more outputs upon which a position of the user interface in the 3-dimensional space can be determined, and the controller is configured to:

provide a calibration routine to determine the one or more user specific body dimensions, in the calibration routine the controller configured to:

instruct the user to hold the user interface in at least one calibration position;

determine the at least one calibration position based on the one or more outputs from the one or more sensors; and estimate the one or more user specific body dimensions based on the at least one calibration position.

In some embodiments, in the calibration routine the controller is configured to:

instruct the user to hold the user interface in a plurality of calibration positions, and with the user interface in each calibration position, determine the calibration position based on the one or more outputs from the one or more sensors; and estimate the one or more user specific body dimensions based on the plurality of calibration positions.

In some embodiments, the controller is configured to determine a 2-dimensional position or coordinate for each calibration position.

In some embodiments, the controller is configured to determine the target movement based on the user's body structure and a predetermined calibration movement.

In some embodiments, the device comprises a memory in communication with the controller, the memory storing a plurality of predetermined calibration movements corresponding to a plurality of exercises that may be performed when using the device.

In some embodiments, each calibration movement is, or is defined by a reference animation, wherein the reference animation is a 3D digital animation of a model of the reference body structure performing a desired exercise.

In some embodiments, the controller is configured to:

generate a user animation based on the reference animation and the user's body structure, wherein the user animation is a 3D digital animation of a model of the user's body structure; and determine the target movement from the user animation.

In some embodiments, the controller is configured to generate the user animation by moving the model of the user's body structure to replicate movement of the reference body structure in the reference animation.

In some embodiments, the controller is configured to move the model of the user's body structure based on a range of motion defined by joint angles of the reference body structure in the reference amination and/or muscle forces in the model of the reference body structure in the reference animation.

In some embodiments, the controller is configured to determine the target movement for the exercise from the user animation.

In some embodiments, the target movement comprises:

a plurality of 3D positions defining a 3D path of the hand or of each hand of the model of the user's body structure in the user animation, and/or a 3D start position and/or a 3D end position of the hand or of each hand of the model of the user's body structure in the user animation.

In some embodiments, the target movement comprises:

a plurality of 3D positions defining a 3D path or 3D paths of one or more joints of the model of the user's body structure in the user animation, and/or a 3D start position and/or a 3D end position of one or more joints of the model of the user's body structure in the user animation.

In some embodiments, the actual movement is of the user's hand or hands.

In some embodiments, the actual movement is of one or more joints of the user's body.

In some embodiments, the target movement comprises a plurality of 3D positions defining a 3D path for the hand or for each hand of the user, and/or a 3D start position and/or a 3D end position for the hand or for each hand of the user.

In some embodiments, the target movement comprises a plurality of 3D positions defining a 3D path or 3D paths for one or more of the user's body joints, and/or a 3D start position and/or a 3D end position for one or more of the user's body joints.

In some embodiments, the one or more sensors is configured to provide one or more outputs upon which a position of the user interface in the 3-dimensional space can be determined; and wherein the controller is configured to:

determine the position of the user interface during use based on the one or more outputs from the one or more sensors;

determine the actual movement of the user based on the position of the user interface as the user moves the user interface when using the device to perform an exercise.

In some embodiments, the position of the user interface is indicative of an actual position of the user's hand when using the device to perform an exercise.

In some embodiments, the controller is configured to determine an actual position of one or more joints of the user's body during use based on the one or more outputs from the one or more sensors.

In some embodiments, the user interface is a handle to be held by the user's hand during use.

In some embodiments, the device comprises one or more load cells in communication with the controller to detect the user's weight, and the controller is configured to determine the user's weight based on one or more outputs from the one or more load cells and estimate the user's body structure based on the user's weight.

In some embodiments, the feedback includes instructions to the user to alter the user's movement when the user's actual movement deviates from the target movement by a predetermined distance.

In some embodiments, the feedback device is an audio feedback device, and wherein the exercise device provides only audio feedback to the user.

In some embodiments, the resistance mechanism comprises an electric motor in communication with the controller and a spool rotationally driven by the motor, and wherein the cable is coupled to the spool; and wherein the controller is configured to operate the motor to generate the force.

In some embodiments, the one or more sensors includes a sensor arrangement configured to detect two orthogonal angles to define a trajectory of the cable extending in the 3-dimensional space during use and a position sensor, and the controller is configured to:

determine a length of cable extending in the 3-dimensional space based on one or more outputs from the position sensor;

determine two orthogonal angles based on one or more outputs from the sensor arrangement; and determine the position of the user interface in the 3-dimensional space based on the length of the cable and the two orthogonal angles.

In some embodiments, the position sensor provides one or more outputs indicative of a rotational position of the motor and/or spool and the length of the cable is based on the motor and/or spool position and a diameter of the spool.

In some embodiments, the controller is configured to determine an exercise being performed by the user from the plurality of exercises based on a comparison between the user's actual movement and the plurality of user specific target movements.

In a preferred embodiment, the device comprises a deck or platform upon which a user stands when using the device, and a pair of said user interfaces, a pair of said cables and a pair of said resistance mechanisms, wherein each user interface is connected to a respective said cable extendable from and retractable into the deck, each cable coupled to a respective said resistance mechanism. The device comprises a pair of said one or more sensors. Each one or more sensors is configured to provide one or more outputs upon which a position of a respective said user interface in the 3-dimensional space can be determined; and the controller is configured to determine the position of each said user interface during use. Preferably, each said one or more sensors comprises a sensor arrangement configured to detect two orthogonal angles to define a trajectory of a respective said cable extending in the 3-dimensional space during use, and a position sensor to determine the length of the cable extending in the 3-dimensional space.

According to a second aspect of the invention, the present invention provides a personal exercise device comprising:

a user interface to be moved by a user in a 3-dimensional space when using the device;

a resistance mechanism to generate a force;

a cable coupled between the user interface and the resistance mechanism to transmit the force from the resistance mechanism to the user interface;

one or more sensors configured to detect movement of the user in the 3-dimensional space when using the device;

a feedback device; and a controller in communication with the one or more sensors, the controller configured to:

determine a user specific target movement for the user based on one or more user specific body dimensions;

determine an actual movement of the user when using the device to perform an exercise based on one or more outputs from the one or more sensors; and provide feedback to the user via the feedback device based on a comparison between the user's actual movement and the user specific target movement.

In some embodiments, the controller is configured to determine the target movement based on an estimate of a user specific body structure (the user's body structure), the user's body structure defined by the relative positions of a part of the user's body associated with the user interface and one or more other parts of the user's body based on the one or more body dimensions.

In some embodiments, the controller is configured to:

estimate a user specific body structure based on the one or more user specific body dimensions, and determine the user specific target movement based on the user specific body structure.

In some embodiments, the controller is configured to determine a plurality of user specific target movements based on the one or more user specific body dimensions, wherein each target movement corresponds to one exercise of a plurality of exercises to be performed when using the device.

In some embodiments, the controller is configured to estimate the user's body structure based on the one or more user specific body dimensions and a predetermined reference body structure.

In some embodiments, the one or more user body dimensions are entered by a user or other person and/or the controller is configured to estimate the one or more user body dimensions.

In some embodiments, the one or more sensors is configured to provide one or more outputs upon which a position of the user interface in the 3-dimensional space can be determined, and the controller is configured to:

provide a calibration routine to determine the one or more user specific body dimensions, in the calibration routine the controller configured to:

instruct the user to hold the user interface in at least one calibration position;

determine the at least one calibration position based on the one or more outputs from the one or more sensors; and estimate the one or more user specific body dimensions based on the at least one calibration position.

In the second aspect, the device may comprise any one or more of the features described above in relation to the first aspect.

According to a third aspect of the invention, the present invention provides a personal exercise device comprising:

a user interface to be moved by a user in a 3-dimensional space when using the device;

a resistance mechanism to generate a force;

a cable coupled between the user interface and the resistance mechanism to transmit the force from the resistance mechanism to the user interface;

one or more sensors configured to detect movement of the user in the 3-dimensional space when using the device;

a feedback device; and a controller in communication with the one or more sensors, the controller configured to:

determine an actual movement of the user when using the device to perform an exercise based on one or more outputs from the one or more sensors;

compare the actual movement to a plurality of target movements, wherein each target movement corresponds to one exercise of a plurality of exercises to be performed when using the device; and determine an exercise being performed by the user from the plurality of exercises based on the comparison between the user's actual movement and the plurality of target movements.

In the third aspect, the device may comprise any one or more of the features described above in relation to the first aspect.

According to a fourth aspect of the invention, the present invention provides an exercise or training device for providing coaching feedback to a user when exercising, the device comprising:

one or more sensors configured to detect movement of the user in a 3-dimensional space;

a feedback device; and a controller in communication with the one or more sensors, the controller configured to:

estimate the user's body structure (based on user entered dimensions, user interface position in calibration routine, and/or from depth camera);

determine a user specific target movement for the user based on the user's body structure;

determine an actual movement of the user when performing an exercise based on one or more outputs from the one or more sensors; and provide coaching feedback to the user via the feedback device based on a comparison between the user's actual movement and the user specific target movement.

In some embodiments, the controller is configured to estimate the user's body structure based on one or more user specific body dimensions.

In some embodiments, the controller is configured to estimate the user's body structure based on the one or more user specific body dimensions and a predetermined reference body structure.

In some embodiments, the controller is configured to:

provide a calibration routine to determine the one or more user specific body dimensions, in the calibration routine the controller configured to:

instruct the user to pose in at least one calibration position;

determine the at least one calibration position based on the one or more outputs from the one or more sensors; and estimate the one or more user specific body dimensions based on the at least one calibration position.

In some embodiments, the controller is configured to determine the target movement based on the user's body structure and a predetermined calibration movement.

In some embodiments, the target movement comprises a plurality of 3D positions defining a 3D path for the hand or for each hand of the user, and/or a 3D start position and/or a 3D end position for the hand or for each hand of the user.

In some embodiments, the target movement comprises a plurality of 3D positions defining a 3D path or 3D paths for one or more of the user's body joints, and/or a 3D start position and/or a 3D end position for one or more of the user's body joints.

In some embodiments, the device comprises a user interface to be moved by a user in a 3-dimensional space and a resistance mechanism coupled to the user interface to provide a force to the user via the user interface. A cable may be coupled between the user interface and the resistance mechanism to transmit the force from the resistance mechanism to the user interface In the fourth aspect, the device may comprise any one or more of the features described above in relation to the first aspect. In the second aspect, the controller may be configured as described in any one or more of the above statements relating to the first aspect.

According to a fifth aspect of the invention, the present invention provides a method for providing coaching feedback to a user when exercising, the method comprising:

estimating the user's body structure (based on user entered dimensions, user interface position in calibration routine, and/or from depth camera);

determining a user specific target movement for the user based on the user's body structure;

determining an actual movement of the user when performing an exercise based on one or more outputs from the one or more sensors; and provide coaching feedback to the user via the feedback device based on a comparison between the user's actual movement and the user specific target movement In some embodiments, the method further comprises estimating the user's body structure based on one or more user specific body dimensions.

In some embodiments, the method further comprises estimating the user's body structure based on the one or more user specific body dimensions and a predetermined reference body structure.

In some embodiments, the method includes a calibration routine to determine the one or more user specific body dimensions, the calibration routine comprising:

instructing the user to pose in at least one calibration position;

determining the at least one calibration position based on the one or more outputs from the one or more sensors; and estimating the one or more user specific body dimensions based on the at least one calibration position.

In some embodiments, the method further comprises determining the target movement based on the user's body structure and a predetermined calibration movement.

In some embodiments, the target movement comprises a plurality of 3D positions defining a 3D path for the hand or for each hand of the user, and/or a 3D start position and/or a 3D end position for the hand or for each hand of the user.

In some embodiments, the target movement comprises a plurality of 3D positions defining a 3D path or 3D paths for one or more of the user's body joints, and/or a 3D start position and/or a 3D end position for one or more of the user's body joints.

In the third aspect, the method may include providing a device according to the first aspect, and/or may comprise additional method steps implemented by the controller as described in any one or more of the above statements relating to the first aspect.

Unless the context clearly requires otherwise, throughout the description and the claims, the term 'user interface' is intended to mean a component to be grasped by a user and/or otherwise engage or be engaged by a user's hand, foot or body, such as, a bar, hand grip, hoop, strap, belt or any other suitable piece of equipment enabling a person to apply tension to a cable attached to the component via the user's hand, foot or body.

Unless the context clearly requires otherwise, throughout the description and the claims, the term 'extend vertically' (or similar terms such as extending vertically) is intended to mean the cable extends in a direction with a significant or predominant vertical component (and may include a horizontal component).

Unless the context clearly requires otherwise, throughout the description and the claims, where more than one controller is described, such as a motor controller and a system controller, one skilled in the art will understand the more than one controller may be implemented by a single controller, such as a single electronic processor. Conversely, where a controller such as a system controller is described, such a controller may be implemented by one or more than one controller, such as two or more electronic processors in electrical communication. One or more controllers may be provided remotely.

The term 'cable' is intended to mean any flexible elongate member capable of transmitting tension, such as a cable, cord, strap, webbing etc, and is not intended to be limited to any particular construction or cross section. For example, a 'cable' described herein could be in the form of a length of webbing with a flat cross section.

Throughout the specification and claims, where one or more sensors provide(s) one or more outputs from which a value or parameter can be determined (such as an angle or position), the one or more outputs are said to be indicative of the value or parameter.

Throughout the specification and claims, terms such as "above" and "below" are used in a relative sense and are not intended to be limiting. One skilled in the art will understand that an arrangement or assembly as described with such relative terms may be inverted so that "above" becomes "below" and vice versa.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

The entire disclosures of all applications, patents and publications cited above and below, if any, are herein incorporated by reference.

Reference to any prior art in this specification is not, and should not be taken as, an acknowledgement or any form of suggestion that that prior art forms part of the common general knowledge in the field of endeavour in any country in the world.

The invention may also be said broadly to consist in the parts, elements and features referred to or indicated in the specification of the application, individually or collectively, in any or all combinations of two or more of said parts, elements or features.

Further aspects of the invention, which should be considered in all its novel aspects, will become apparent to those skilled in the art upon reading of the following description which provides at least one example of a practical application of the invention.

BRIEF DESCRIPTION OF THE DRAWINGS

One or more embodiments of the invention will be described below by way of example only, and without intending to be limiting, with reference to the following drawings, in which:

FIG. 10A shows a model of a reference body structure from the animation in a start position for an exercise, and FIG. 10B shows the model of the reference body structure in an end position for the exercise;

BRIEF DESCRIPTION OF PREFERRED EMBODIMENTS OF THE INVENTION

Figure 1A:
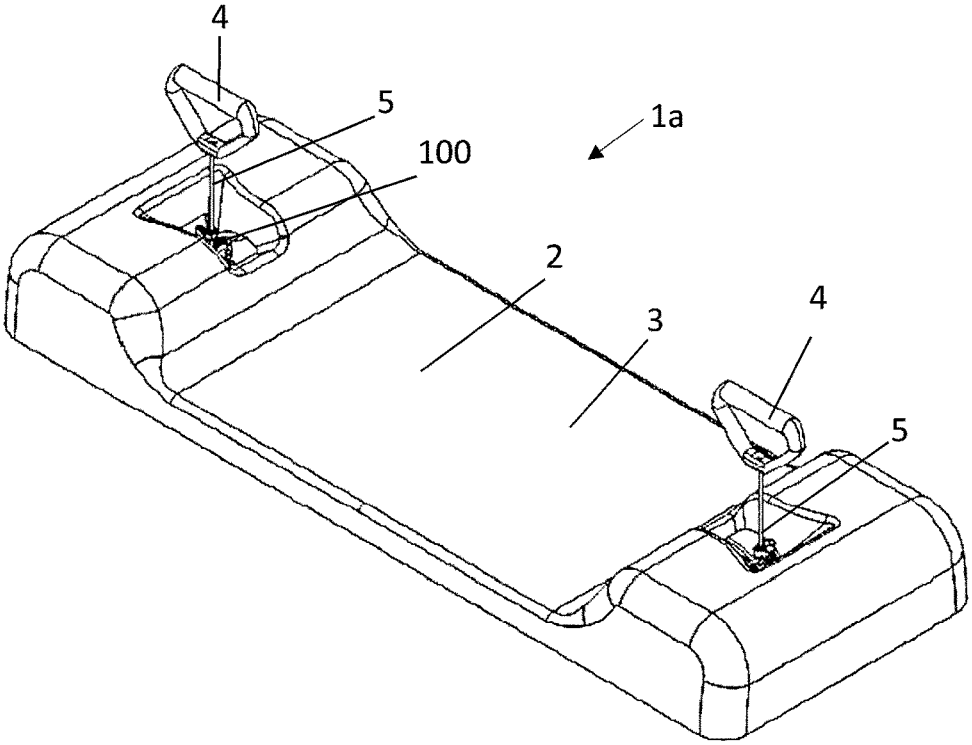
FIG. 1A illustrates one embodiment of an exercise device according to an aspect of the present invention.
Figure 1B:
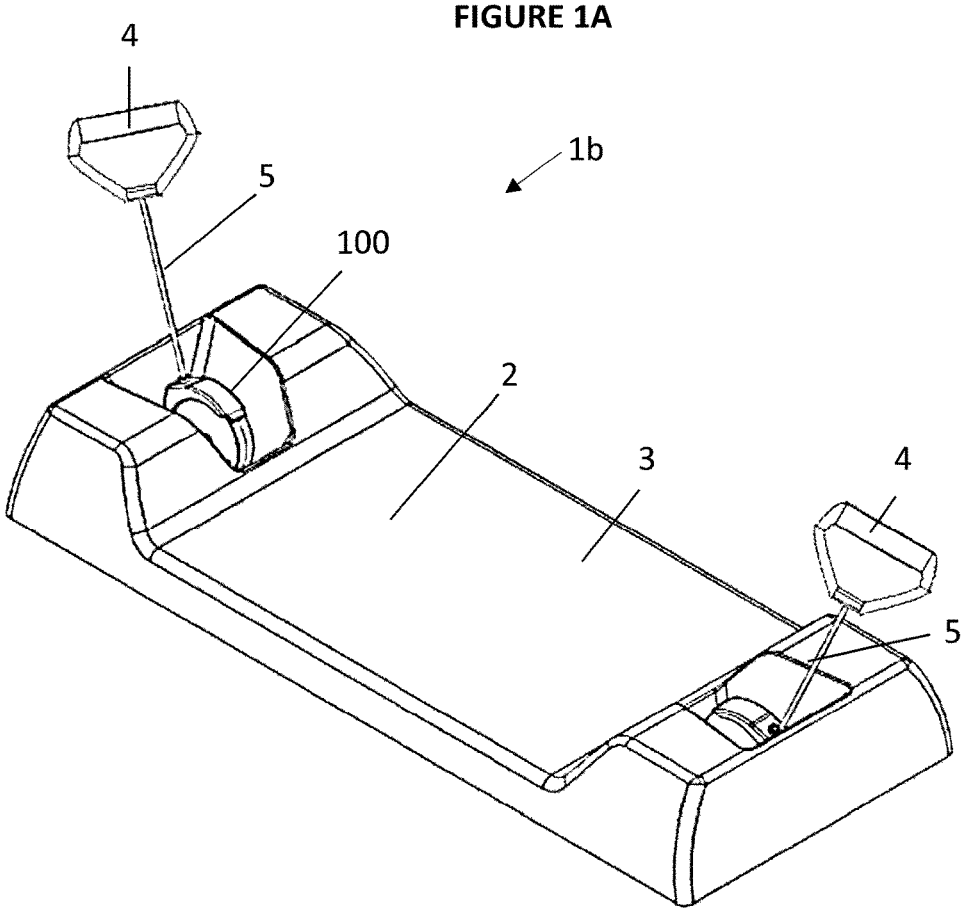
FIG. 1B illustrates another embodiment of an exercise device according to an aspect of the present invention.

FIGS. 1A and 1B show two example embodiments of a resistance exercise device according to one or more aspects of the present invention. Each device 1*a*, 1*b* comprises a frame or housing 2 (herein housing) to house or contain or mount various components of the device 1*a*, 1*b*. In the illustrated embodiments the housing 2 presents a deck or platform 3 upon which a user stands when using the device 1*a*, 1*b*. A pair of user interfaces (herein 'handles') 4 are provided to be gripped by the user. Each handle 4 is connected to a respective flexible elongate member (herein 'cable') 5 extendable from and retractable into the housing 2. Each cable 5 is coupled to a resistance mechanism (hidden from view in FIGS. 1A and 1B) mounted within the housing 2 to provide resistance to the user via the cables 5 and handles 4 as the user lifts the handles 4 to extend the cables 5 from the housing 2 and lowers the handles 4 towards the housing 2.

The resistance mechanism (described below) provides a force or resistance (force) to a respective cable 5. The cable 5 is coupled between the resistance mechanism and the handle 4 to transmit the force from the resistance mechanism to the user via the handle 4 with the cable 5 in tension. When the user provides a force to the handle 4 that is greater than the force provided to the cable 5 by the resistance mechanism, the user lifts the handle 4 and extends the cable 5 from the housing 2. When the user provides a force to the handle 4 that is less than the force provided by the resistance mechanism to the cable 5, the resistance mechanism retracts the cable 5 into the housing 2 as the user lowers the handle 4 towards the housing 2.

Figure 2A:
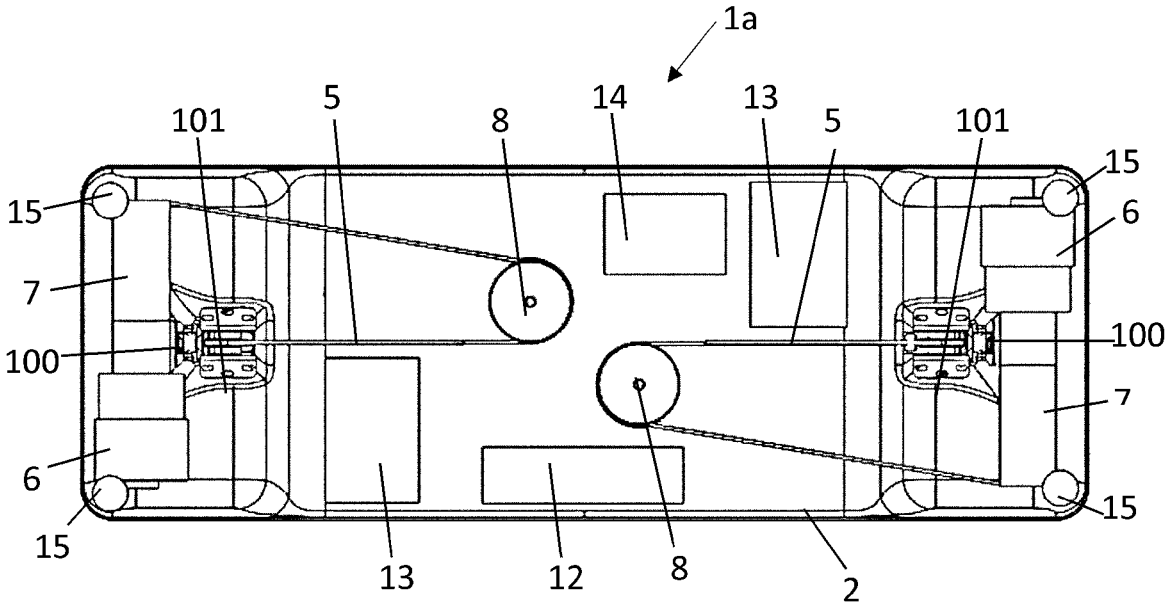
FIG. 2A is a bottom view of the device of FIG. 1A to show various components of the device mounted within a housing of the device.

FIG. 2A provides a bottom view of the device 1*a* of FIG. 1A with a bottom cover removed to show internal components of the device 1*a*. The resistance mechanism comprises an electric motor 6 and a spool 7 coupled to the motor 6 on which the cable 5 wraps and unwraps as the cable 5 is retracted into the housing 2 and extended from the housing during use. In this illustrated embodiment, the spool 7 is directly coupled to the motor, for example a shaft of the motor is directly coupled to the spool, with a rotational axis of the spool collinear with a rotational axis of the motor. To achieve a low-profile deck or housing, the motor 6 and spool 7 are arranged towards one end of the device 1*a*. The cable 5 extends from the spool 7 and passes around a first pulley 8 to align the cable 5 with an opening through the housing. The cable 5 extends from the first pulley 8 in a substantially horizontal plane. The cable 5 passes around a second pulley 101 to orient the cable from extending horizontally below the deck 3 or top surface of the housing 2 to extend vertically through the opening in the housing 2. In the illustrated embodiment, the motor 6 and spool 7 have a horizontal axis, the first pulley 8 has a vertical axis, and the second pulley 101 has a horizontal axis.

The arrangement of the cable 5, motor 6, spool 7 and pullies 8, 101 is replicated at each end of the device 1*a*, to provide force to two handles 4 of the device 1*a*. One skilled in the art will understand that in some embodiments, only one motor, spool, cable and pulley set may be provided to provide force to a single handle of the device. In such an embodiment, the cable may extend through a centrally located opening in the deck/housing 2.

Figure 2B:
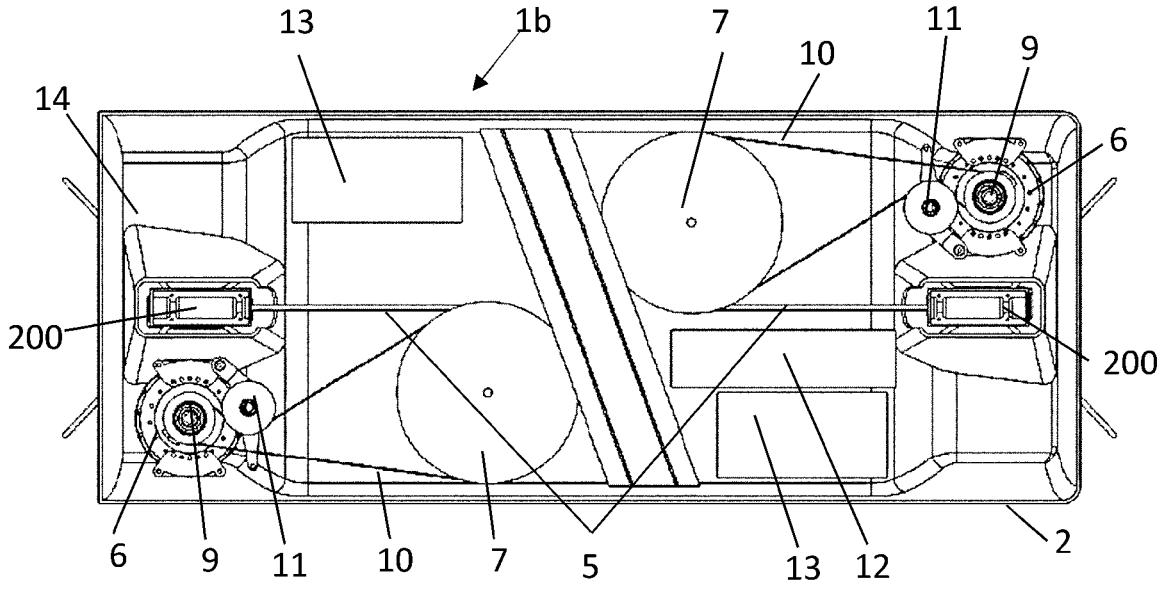
FIG. 2B is a bottom view of the device of FIG. 1B to show various components of the device mounted within a housing of the device.

FIG. 2B provides a bottom view of the device 1*b* of FIG. 1B with a bottom cover removed to show internal components of the device 1*b*. In this embodiment, the motor 6 is mounted with a rotational axis of the motor oriented vertically. The motor 6 drives rotation of a spool 7 via a drive pulley 9 directly coupled to the motor 6 and a belt 10 extending between the drive pulley 9 and the spool 7. An idler pulley 11 tensions the belt 10. To achieve a low-profile housing, the motor 6 is arranged towards one end of the device 1*b* and the spool 7 is mounted nearer to a centre of the housing 2 with a vertical rotational axis and a relatively large diameter. The spool rotational axis is parallel to the motor axis. The spool 7 has a relatively large diameter so that the number of wraps of cable on the spool 7 is reduced and the height of the spool 7 mounted with a vertical axis is minimised. The cable 5 wraps and unwraps to and from the spool 7 as the cable 5 is retracted into the housing 2 and extended from the housing 2 during use. The spool 7 is positioned to align the cable 5 with an opening through the housing 2. The cable extends from the spool 7 approximately horizontally and passes around a further pulley (pulley 201 in FIG. 4C, hidden from view in FIGS. 2A and 2B) to orient the cable from extending approximately horizontally within the housing to extend vertically through the opening in the housing 2.

The arrangement of motor, spool and pulley of the device of FIGS. 1A and 2A achieves a reduced width device compared to the motor, spool and belt drive arrangement of FIGS. 1B and 2B. However, the arrangement of FIGS. 1B and 2B achieves a shorter length device.

Figure 3:
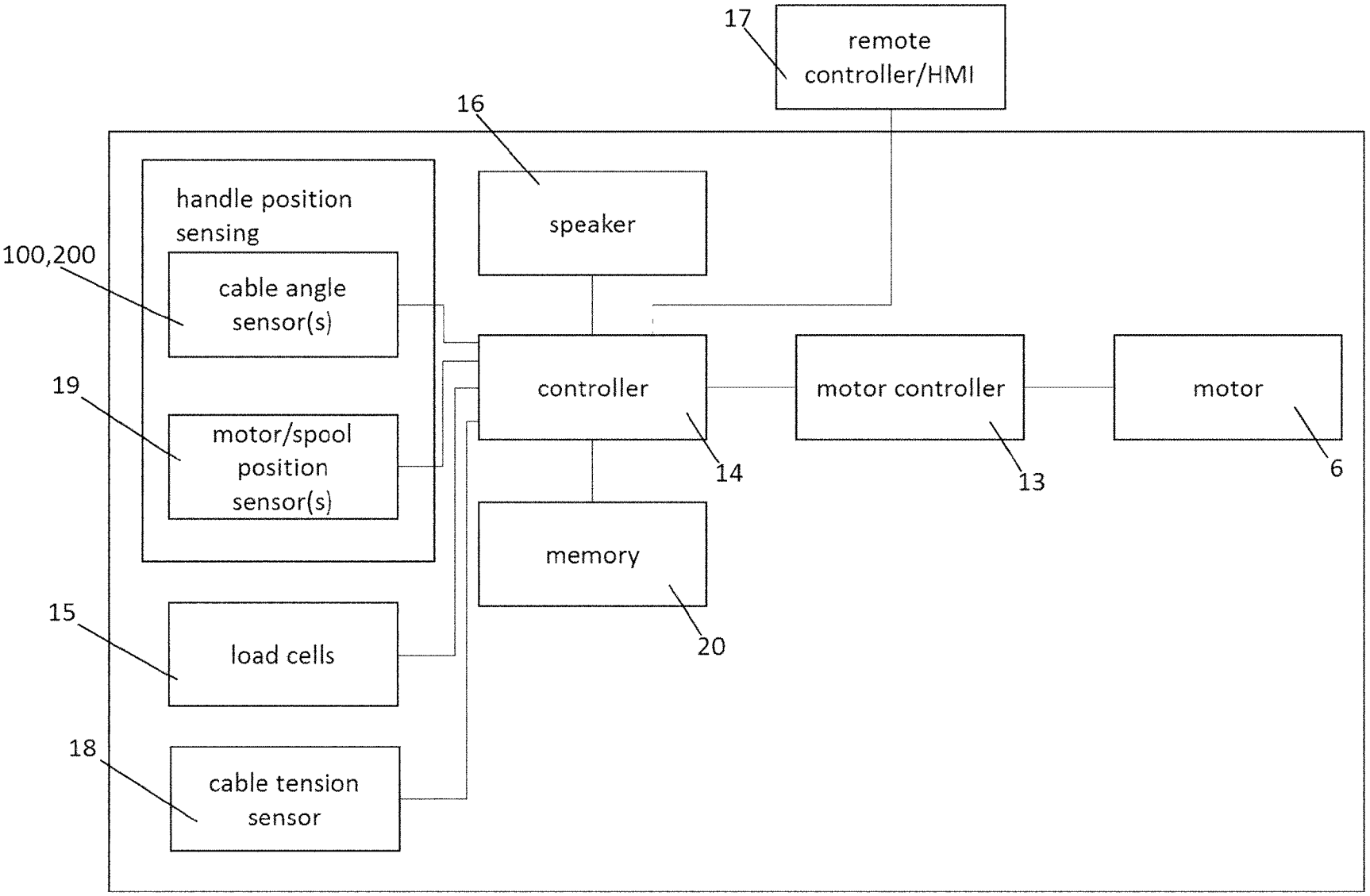
FIG. 3 illustrates example architecture for the exercise devices of FIGS. 1A and 1B.

Again, with reference to FIGS. 2A and 2B, and with reference to FIG. 3 illustrating an example device architecture, other components of each device 1*a*, 1*b* include a power supply 12, a motor controller 13 and a system controller 14. Preferably the power 12 supply is or comprises a (preferably rechargeable) battery to allow for portability so that the device 1*a*, 1*b* can be transported and used for a period of time without requiring an external power supply.

Preferably each motor 6 is controlled by the motor controller 13 to operate the motor 6 in a torque control mode to provide a force to the cable 5. In torque control mode, a position of the handle 4, motor 6 or spool 7 may not be communicated to the motor controller 13. In torque control mode, the motor controller 13 may control the motor 6 to provide a relatively constant force to the cable 5, regardless of handle or motor or spool position. As described above, when a user pulls on a handle 4 with a force (user force) greater than the force provided by the motor and spool to the cable 5 (motor force), the user lifts the handle 4 from the housing, unwrapping the cable 5 from the spool 7 against the motor force. When the user holds a handle 4 stationary, the user force is equal to the motor force and the motor and spool remain stationary. And when the user lowers the handle 4 the user force is less than the motor force, and the motor winds the cable 5 onto the spool 7. In torque control mode the motor operates to keep the cable under tension. In some embodiments, a tension or force sensor (not shown) may communicate a cable tension to the motor controller for use in the control of the motor.

When the user pulls the cable 5 to unwind the cable from the spool 7, the motor 6 may operate in a generator or brake mode to provide the controlled torque or force to the cable 5. When the motor 6 operates to rewind the cable 5 onto the spool 7, the motor 6 operates in a motor or driving mode. When in the generator or brake mode, the motor 6 generates electrical power. The device 1*a*, 1*b* may further comprise a recharging module (not shown) configured to apply the generated electrical power to the power supply 12 to recharge the battery. Alternatively, or additionally the device 1*a*, 1*b* may include an electrical resistance to dissipate some or all generated electrical power.

The system controller 14 provides control logic/routines for the device 1*a*, 1*b*. For example, the system controller 14 may be configured/programmed to provide one or more exercises for the user to perform. Preferably the controller 14 is configured to provide a plurality of exercises, and more preferably is configured to allow the user (via a Human Machine Interface 17) to select one or more exercises from a plurality of exercises. The controller 14 may determine an exercise routine based on user information. The system controller 14 may cause the motor controller 13 to control the motor 6 to provide a force to the cable 5 via the spool 7 to replicate traditional weightlifting exercises, for example, bicep curls or squats and the like. The controller 14 may allow the user to select a range of weight levels up to a maximum weight. For example, the motor and spool may be configured to apply force to the cable 5 to present a maximum force of 20 kgf (200 N) or more at the respective handle 4.

The system controller 14 may be configured to monitor the user's performance or use of the device while exercising via sensors and provide feedback to the user, for example audio feedback via an audio output device (e.g. electromechanical speaker 16 in FIG. 3). Feedback may include coaching feedback to coach the user to improve exercise technique, and/or may provide motivational feedback based on user output, such as speed/pace of exercise, exercise duration, weight lifted etc. As a further example, the system controller 14 may be configured to use the sensor data to calculate exercise intensity parameters, such as work output, based on the user's movements sensed by the device.

The device 1*a*, 1*b* may include Human Machine Interface such as a touch screen or display screen and user controls, to allow the user to provide one or more user inputs. In some embodiments, the HMI may be provided by a personal electronic device (17 in FIG. 3) such as a smart phone to communicate with other components of the device 1*a*, 1*b* such as the system controller 14, the motor controller 13, and/or sensors. In the illustrated embodiments the system controller 14 is indicated as being part of the device 1*a*, 1*b*, however in some embodiments the system controller 14 may be provided by a separate device such as a personal electronic device (such as a smart phone) to communicate with the other components of the device 1*a*, 1*b* such as the motor controller 13, and/or sensors of the device.

Communication between a remote controller and/or HMI and the other components of the device may be provided by way of a communication protocol or network (for example Bluetooth, a cellular network, or another network optionally comprising various configurations and protocols including the Internet, intranets, virtual private networks, wide area networks, local networks, private networks using communication protocols proprietary to one or more companies—whether wired or wireless, or a combination thereof). A feedback device may also be provided via a separate remote device, again by a personal electronic device such a smart phone, for example.

The device 1*a*, 1*b* includes one or more sensors for use in the control of the device 1*a*, 1*b* and/or to provide feedback to the user, as mentioned above. For example, sensors may include a force (tension) sensor (18 in FIG. 3) to provide an indication of force applied to the cable, a motor and/or spool position sensor (19 in FIG. 3), and/or one or more load cells to determine the weight of the user. FIG. 2A shows four load cells 15, each load cell provided adjacent a corner of the device 1*b*. Output from the load cell(s) 15 may be used to measure the user's weight or determine a user's position on the deck. The load cells may be used to determine the user's weight to suggest exercises, and/or be used to determine feedback/instruction to the user to stand on the deck correctly.

The device 1*a*, 1*b* comprises a position sensor (19 in FIG. 3) to detect a rotational position of the spool 7 and/or motor 6 and/or a datum point reference for the length of cable extending from the housing. The system controller 14 may be configured to determine a cable length extending from the device 1*a*, 1*b* based on one or more outputs from the position sensor. An example position sensor is a rotary encoder to determine a rotational position of the motor. The system controller may determine/calculate a length of cable extending from the housing based on the motor position.

A sensor arrangement 100, 200 may be provided to detect two orthogonal angles of the cable 5 extending from the housing 2. The system controller 14 is configured to determine two orthogonal angles defining a trajectory of the cable 5 extending from the housing 2 based on one or more outputs from the sensor arrangement 100, 200. The system controller 14 is further configured to determine, from the two orthogonal angles and the cable length, a 3-dimensional position of the handle 4 (handle position) in a 3-dimensional space occupied by the user when using the device 1*a*, 1*b*. The handle position may be determined from the two angles and the cable length based on a spherical coordinate system.

A sensor arrangement 100, 200 for detecting the two orthogonal angles and a controller configured to determine the handle position based on the two orthogonal angles and cable length, with the cable length based on motor or spool position, is described in New Zealand provisional patent application 768769, the contents of which is incorporated herein by reference.

Alternative sensor arrangements may be provided to determine the position of the handle in 3-dimensional space. For example, a position sensor may be provided at or adjacent to each handle to communicate positional data (for example wirelessly) to the controller. However, this may be less preferred since electrical power must be provided to the sensor located at or near to the handle.

Since the user holds the handles during use, the position of the handles provides a position of the user's hands during use. The sensor arrangement is therefore configured to detect movement of the user when using the device. Other positions of the user's body such as the user's body joints may be derived from the user's hand position. Other user interfaces may be used in addition to, or alternative to one or two handles, for example a user interface to engage a user's foot and/or a user interface to engage a user's waist or upper body. A person skilled in the art will understand a position of the user interface may be used to provide a position and therefore movement of the user during use.

Figure 4:
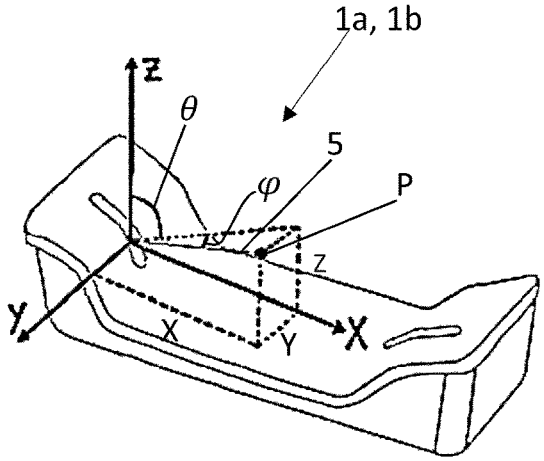
FIG. 4 provides a schematic representation of the devices of FIGS. 1A and 1B indicating a coordinate system for the position of a handle of the devices in a 3-dimensional space during use.

The controller 14 is preferably configured to calculate a 3-dimensional coordinate position for the handle in a 3-dimensional space in which the handle is movable during use. In a preferred embodiment the controller is configured to determine an (x, y, z) cartesian coordinate for the handle position P in a cartesian coordinate system, as illustrated in FIG. 4. In the illustrated example the x-dimension is in a side-to-side direction of the device (extending between the handles), the y-direction is in a front-to-back direction of the device, and the z-direction is vertical.

The controller 14 may use the handle position in the control of the device 1*b*, 1*b* and/or to determine feedback to be provided to the user. In embodiments described herein, the controller 14 determines coaching or user performance feedback based on the handle position, and/or may update exercise routines or make exercise suggestions to the user based on the handle position. In a preferred embodiment, the controller determines and monitors the handle position real time during use, to provide real time feedback and/or updates to the user during exercise.

The controller 14 is configured to determine a desired or target movement that a user of the device is to perform and provide feedback to the user based on a comparison between the user's actual movement and the target movement. For example, where the user's actual movement deviates (beyond a distance threshold) from the target movement, the controller may cause the device to provide user feedback in the form of instructions to the user to correct the user's movement to achieve the target movement. The desired or target movement may be an ideal movement in order to optimally perform a particular exercise.

The target movement is user specific. That is, the target movement is determined for each individual user of the device. A target movement for a user is dependent on the user's own body dimensions or proportions. A larger user will have a different target movement compared to a smaller user. A method for determining a user specific target movement is now described.

Figure 5:
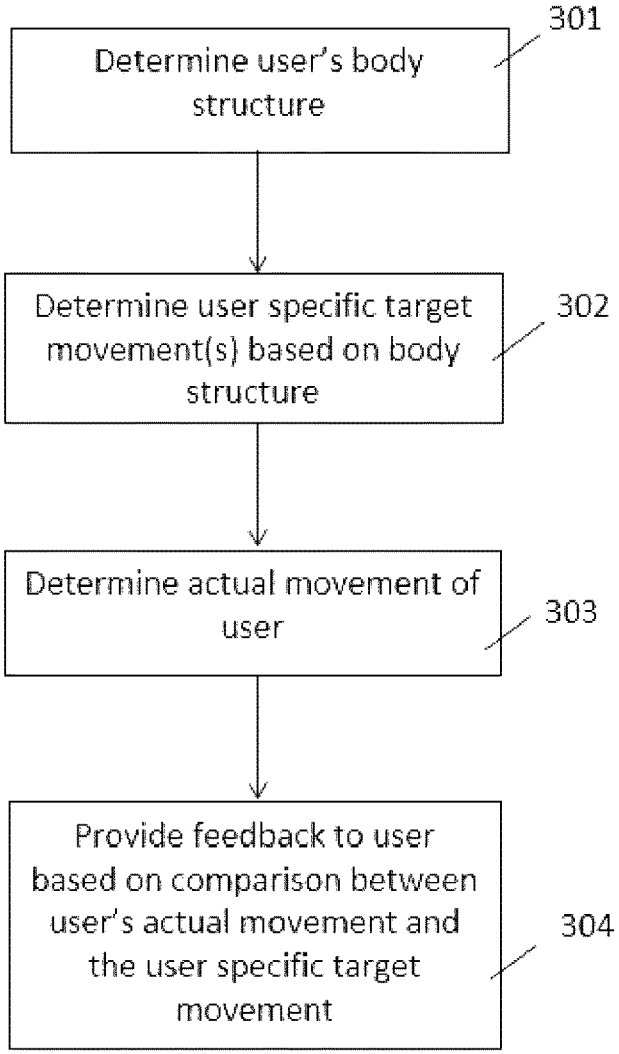
FIG. 5 provides a flow diagram illustrating a method for providing feedback to a user during exercising.
Figure 7:
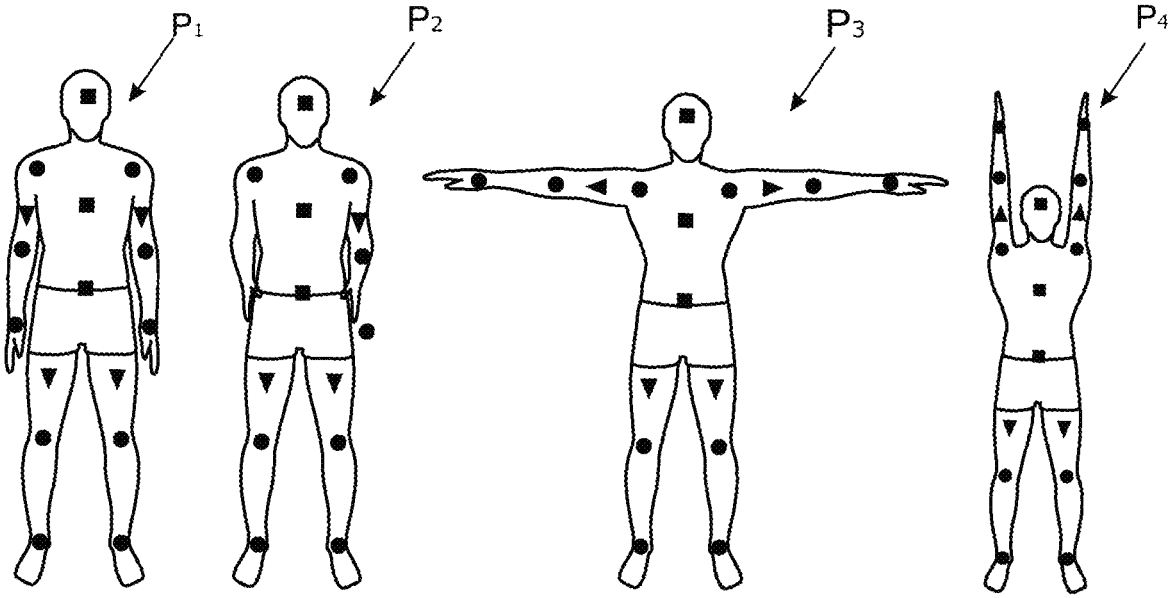
FIG. 7 illustrates a person in four calibration poses to hold handles of the devices of FIGS. 1A and 1B in four calibration positions.

With reference to FIG. 5, to determine a user specific target movement, the device is configured to estimate the user's individual or specific physical body structure (301), defined by the relative positions of the user's hands (or other body part associated with the user interface in use) and one or more other parts of the user's body, such as joints of the user's body, for example as indicated by the circular dots in FIG. 7. The relative positions of the user's hands/user interface and other parts/joint(s) of the user's body are based on one or more user body dimensions such as leg length, arm length, height and/or torso length. Additionally, the output from load cells on the deck of the device (if present) may provide supplementary information, such as the weight of the user, which may be used by the device in estimating the user's body structure. Once the user's body structure is known, the device is configured to determine a user specific target movement for each exercise to be performed by the user of the device based on the user's own estimated body structure (302). The user specific body structure is determined prior to the user commencing exercises. During exercising, the controller is configured to determine an actual movement of the user during exercising (303) and provide feedback to the user based on a comparison between the user's actual movement and the user's specific target movement (304).

In a preferred embodiment of the device, the controller 14 is configured to provide a calibration routine to determine the user's body dimensions and thereby estimate the user's physical body structure prior to commencing exercises. In the calibration routine, the controller instructs, for example via audio instruction via an electromechanical speaker, the user to hold one or both handles of the device in a calibration position. The controller determines the position of the handle(s) in the calibration position, and then estimates the user's physical structure based on the calibration position.

Figure 6:
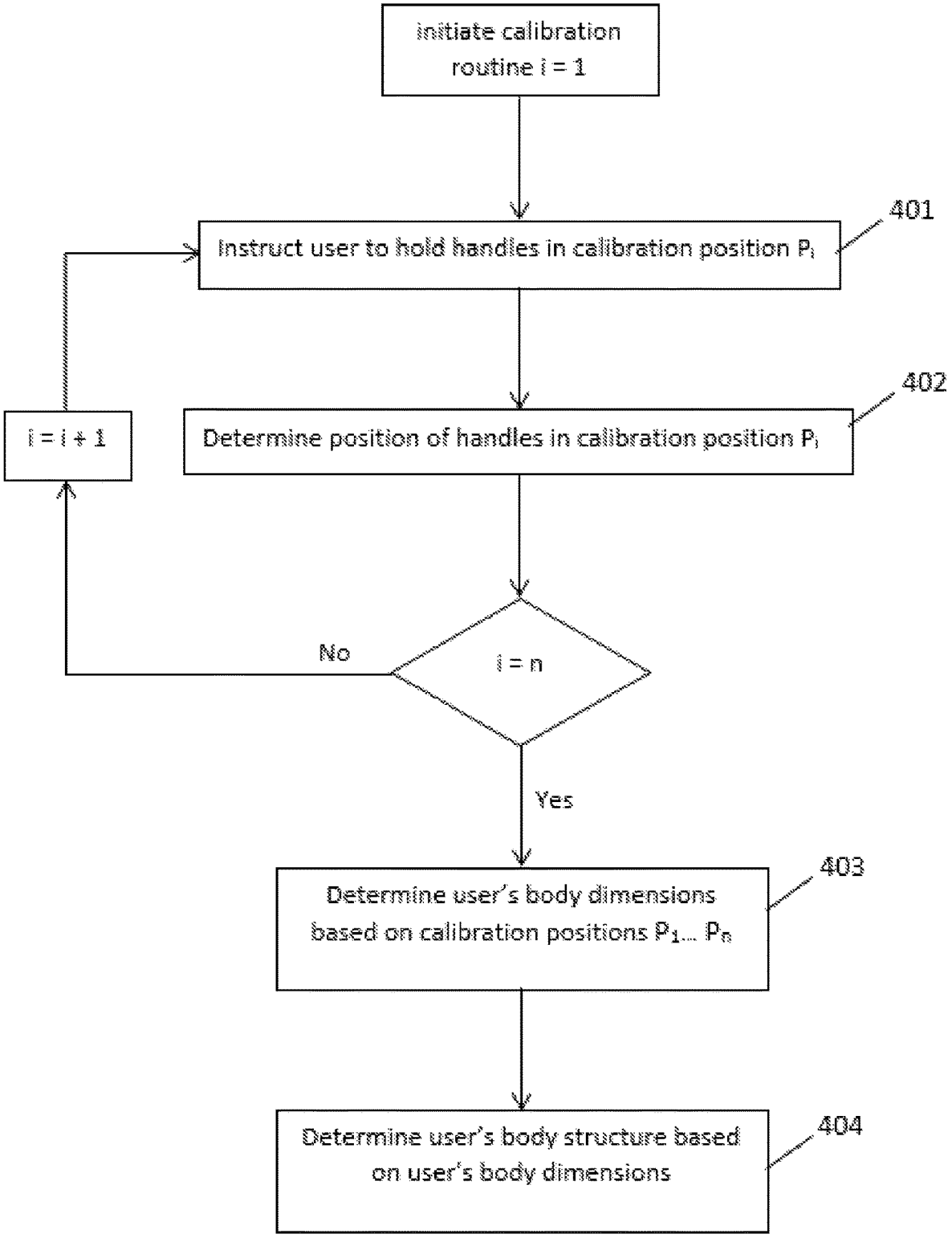
FIG. 6 provides a flow diagram illustrating a calibration routine for determining a user's body structure.

Preferably the controller determines the user's body structure based on a plurality of calibration positions. For example, with reference to FIG. 6, the controller instructs the user to hold one or both handles of the device in a first calibration position $P_1$ (401), e.g. position $P_1$ in FIG. 7. The controller determines the position of the handle(s) in the first calibration position (402), and then instructs the user to move the handles to a second calibration position $P_2$, e.g. position $P_2$ in FIG. 7, and then determines the position of the handle(s) in the second position. The process (401, 402) is repeated for all calibration positions, which in the present example includes four calibration positions $P_1$, $P_2$, $P_3$ and $P_4$, however there could be fewer than four or more than four calibration positions.

In the illustrative example, in calibration $P_1$ the user holds the handles beside his or her body with arms in a relaxed position, in calibration point $P_2$ the user holds the handles at the height of his or her hip joints, in calibration point $P_3$ user holds the handles at his or her shoulder height with arms outstretched, and in calibration point $P_4$ the user holds the handles above his or shoulders with arms outstretched. Preferably the calibration positions are easily identifiable by the user, for example, in the above example calibration positions $P_1$, $P_3$ and $P_4$ are easily identifiable whereas for $P_3$ it may be more difficult for the user to correctly identify the hip joint position. Other calibration positions are possible, for example the user's waist indent is easily identifiable by the user and may be used as a calibration position.

Once the controller has determined the plurality of calibration positions, the controller then determines the user's body structure based on the plurality of calibration positions.

In a preferred embodiment, the controller is configured to determine one or more user body dimensions (403). Based on the above example calibration positions, the controller may be configured to calculate the following user dimensions, where z is the vertical direction and x is the horizontal direction across the user's body, i.e. $z_1$ is the position coordinate in the vertical direction for calibration position $P_1$, and $x_1$ is the position coordinate in the horizontal direction across the user's body for calibration position $P_1$:

$$\text{Shoulder Height } (SH) = \frac{z_4 + z_1}{2}$$

$$\text{Arm Length } (AL) = \frac{z_4 - z_1}{2}$$

$$\text{Torso Length } (TL) = \frac{z_4 + z_1}{2} - z_2$$

-continued $$\text{Leg Length } (LL) = z_2$$

$$\text{Shoulder width } (SW) \approx \Delta x_4 \approx \Delta x_1$$

(where $\Delta x$ is the distance between left and right handles)

$$\text{Hip Width } (HW) = \Delta x_2$$

It is to be noted that the above body dimensions are determined based on three calibration positions, $P_1$, $P_2$ and $P_4$. The three calibration positions are used to generate six body dimensions. However, the controller may determine the user's body structure based one or more body dimensions, for example, one or more of the above six body dimensions. For example, the user's leg length or shoulder height may be used to estimate the user's body structure by scaling between the user's leg length or shoulder height and a human leg length or shoulder height based on statistics for average human body dimensions. Relying on only leg length requires a single calibration position ($P_2$) and relying only on shoulder height requires two calibration positions ($P_1$ and $P_4$). However, preferably the user's body structure is determined based on at least arm length, leg length and shoulder height and/or torso length. To determine the shoulder height, arm length, torso length and leg length the position from only one handle may be required. The user's shoulder width and/or hip width and/or other body dimensions may be used, in which case the position from both handles may be required. Other calibration positions may also be used, for example a useful calibration position may be having the user hold the right hand handle in front of the user's left shoulder, and/or having the user hold the left hand handle in front of the user's right shoulder, to give the user's shoulder height. Again, only a single calibration position may be required if only the shoulder height is used in the estimation of the user's body structure.

Calculation of the user's dimensions may include inaccuracies where the user fails to hold the handles in the correct calibration positions. For example, a user may not hold the handles directly above his or her shoulders when the controller is determining calibration position $P_4$. It may therefore be desirable to include additional calibration positions which provide redundancy in the calculations to essentially 'double check' the calculation of the user's body dimensions. Where redundancy in the calculation of a body dimension shows a discrepancy between two or more different ways of calculating the body dimension, the controller may cause instructions to the user to repeat one or more calibration positions to reduce an error or discrepancy between alternative calculations.

For example, in the illustrative embodiment, calibration position $P_3$ provides an alternative way to determine the shoulder height, arm length, torso length, leg length and shoulder width by the following equations:

$$\text{Shoulder height } (SH) = z_3$$

$$\text{Arm Length } (AL) = \frac{\Delta x_3 - \Delta x_4}{2}$$

$$\text{Arm Length } (AL) = \frac{\Delta x_3 - \Delta x_1}{2}$$

$$\text{Torso Length } (TL) = z_3 - z_2$$

$$\text{Leg Length } (LL) = z_3 - \frac{z_4 - z_1}{2} + z_2$$

-continued $$\text{Shoulder Width } (WL) = \Delta x_3 - z_4 + z_1$$

Once the controller has determined the required body dimensions, the controller is further configured to determine an estimation of the user's body structure.

The user's body structure is determined from the calculated body dimensions (404). The controller may determine the user's body structure based on the user's calculated body dimensions and a predetermined 'reference' human body structure. The reference human body structure may be based on statistical data, for example may be an average of statistical data, or data for an average height/size person, or may be based on an individual real person, such as an expert trainer or athlete. A plurality of reference human body structures may be provided. The controller may select a reference human body structure from the plurality of reference human body structures based on user inputs such as the user's height, sex, age and/or weight. Age, height and/or sex may be user inputs. Weight may be a user input or may be determined by the load cells 15.

Figure 8:
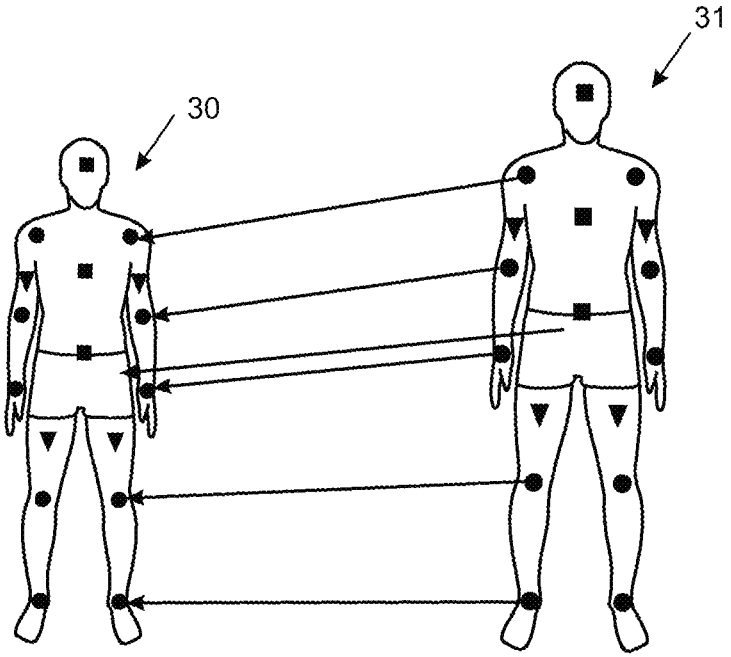
FIG. 8 illustrates a scaling process to determine a user's specific body structure by scaling from a predetermined reference human body structure based on body dimensions of the reference human body structure and body dimensions of the user.

FIG. 8 illustrates a scaling process to determine the user's specific body structure 30 by scaling from the predetermined reference human body structure 31 based on the arm, leg and torso lengths of the reference human body structure and the user's arm, leg and torso lengths. For example, the user's body structure 30 is determined by scaling body dimensions of the reference body structure 31 up or down to be equal to the user's body dimensions to estimate the relative positions of the user's joints. For example, the positions of the user's shoulder, hip and ankle joints may be determined from the calculated body dimensions, and the positions of the elbow and knee joints may be determined based on the calculated body dimensions and the scaling process from the reference body structure, to estimate the body structure or model for the user. Some dimensions, such as hip width and shoulder width, may be derived solely from the reference body structure 31. The scaling process to determine the user body structure based on a reference body structure may be based on a single body dimension only, such as torso length or user's height. In some embodiments, the model is a 2D model based on 2D coordinates for the hands and joints of the user's body.

In the illustrated embodiment of FIG. 8 the user's body structure is defined by the relative positions of the hands corresponding with the handles/user interface in use and the following joints of the body: ankles, knees, hips, shoulders, elbows and wrists. However, the body structure may be defined by the part of the body corresponding to the user interface in use and one or more joints of the user, such as one or more of the above six (pairs of) joints, or another part of the user's body. For example, the body structure may be defined by a user's knees, elbows and shoulder joints, or by the user's shoulder and elbow joints, or by the user's shoulder joints.

Once the user specific body structure has been defined, the controller is further configured to determine a user specific target movement for each exercise to be performed by the user when using the device based on the user specific body structure. A method for determining a target movement based on the user's body structure is now described.

Figure 9:
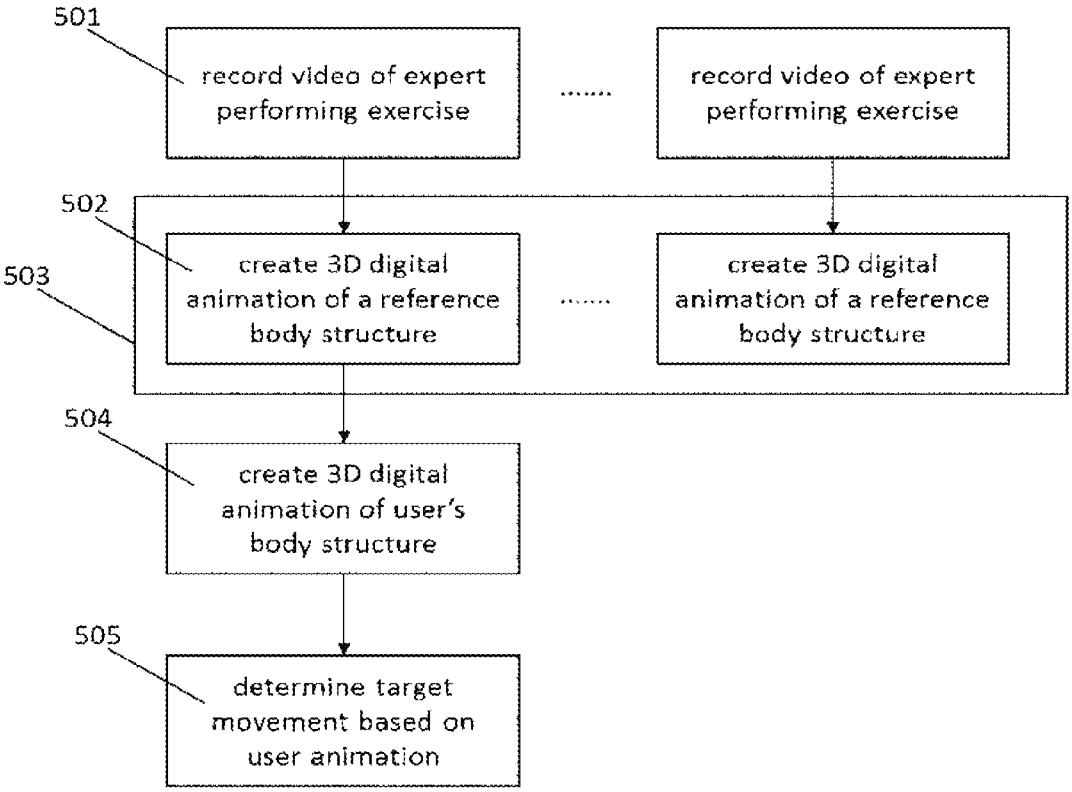
FIG. 9 provides a flow diagram illustrating a method for determining a target movement for a user when using the exercises devices of FIGS. 1A and 1B.

In a preferred embodiment, the user target movement is determined based on a predetermined calibration movement for an exercise to be performed when using the device. With reference to FIG. 9, the calibration movement is preferably created based on an exercise performed by an expert exercise trainer or athlete. A video recording (501) may be made of the expert performing a desired exercise using a video recorder or motion capture system, i.e. an exercise being performed in a correct or ideal way. A digital artist may create a 3D digital animation of a model (i.e. an avatar) of the reference human body structure performing the desired exercise in 3D space based on the recording of the exercise expert or athlete (502), using computer animation software such as Autodesk Maya™. The digital animation of the model of the reference body structure may be referred to as the 'reference animation'.

Figure 10A:
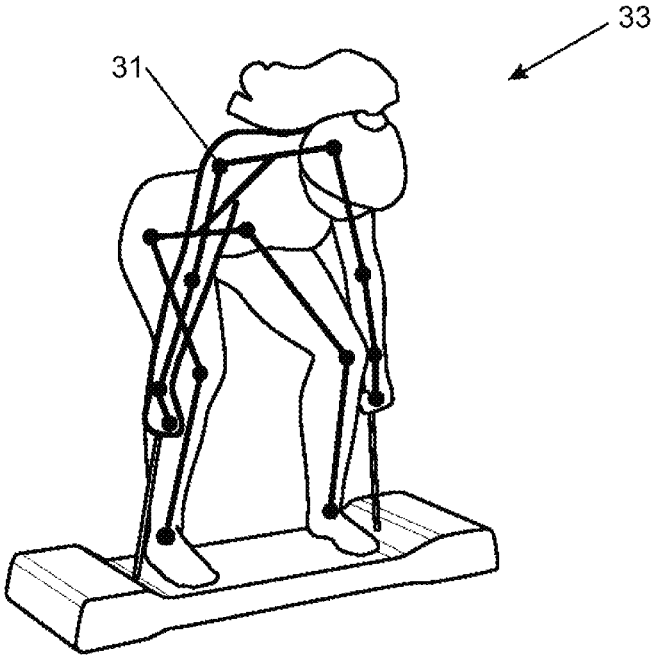
FIGS. 10A and 10B illustrate frames from a reference animation providing a calibration movement for an exercise.
Figure 10B:
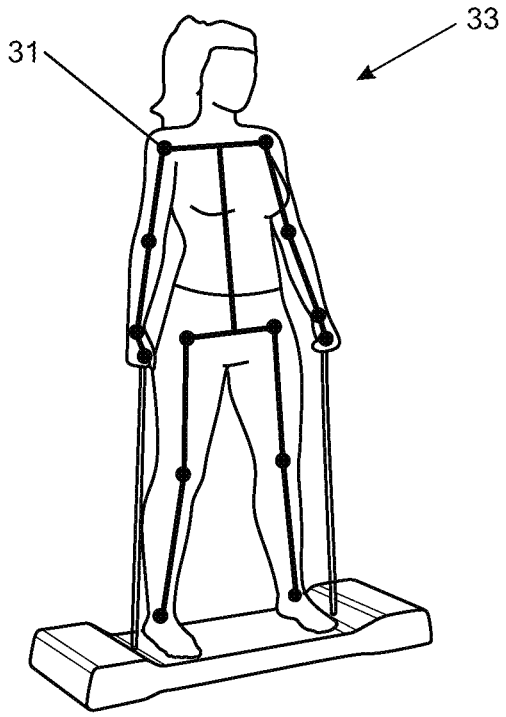

FIGS. 10A and 10B show frames from an example reference animation 33, with FIG. 10A showing the reference body structure 31 in a start position for an exercise, and FIG. 10B showing the model of the reference body structure 31 in an end position for the exercise. The animation includes many frames or positions for the reference body structure in between the start and end positions. As mentioned above, the reference body structure 31 may be the body structure of a real person or based on statistical data for human body structure. The reference animation includes position information for the position of the hands of the reference body structure, and preferably position information for the position of one or more joints of the reference body structure. The reference animation provides or defines the calibration movement for a particular exercise to be performed, such as a bicep curl.

Again with reference to FIG. 9, preferably the device comprises a memory (20 in FIG. 3) storing a library of calibration movements (503) corresponding to a plurality of exercises that may be performed when using the device, each calibration movement being a digital animation of the model of the reference body structure 31 performing one of the plurality of exercises. Each digital animation may be saved as an electronic file in the device memory.

The target movement for an exercise is determined from the calibration movement for that exercise and the user's body structure. In the illustrated embodiment, the controller is configured to generate a 3D digital animation of a model of the user's body structure (user animation) by moving the model of the user's body structure in the same way as the reference body structure moves in the reference animation (504). The model of the user's body structure is moved to replicate the movement of the reference body structure in the reference animation to create the user animation of the user body structure performing the desired exercise. To generate the user animation the controller may be configured to move the model of the user body structure based on a range of motion defined by joint angles of the reference body structure in the reference amination. For example, the model of the user body structure is moved so that the joint angles in the user animation are equal to the joint angles in the reference animation. Additionally, or alternatively, to generate the user animation, the controller may be configured to move the model of the user's body structure based on muscle forces in the model of the reference body structure in the reference animation. For example, the model of the user body structure is moved so that the muscle forces in the user animation are equal to the muscle forces in the reference animation. The user animation may be generated from the reference animation (for example based on joint angles and/or muscle forces) using a gaming engine such as Unity™.

The user's body structure may be a 2D body structure, i.e. the position of the joints of the user's body structure may be defined by 2D coordinates. However, the user animation is a 3D animation of the user's body structure. The 3D digital animation of the model of the user's body structure is generated based on the 3D animation of the model of the reference body structure and the user's 2D body structure.

The controller is further configured to determine the target movement for the exercise from the user animation (505). For example, the controller is configured to track the 3D position of the hand or hands of the model of the user's body structure in the user animation. In a preferred embodiment, the target movement is defined by a plurality of 3D positions defining a 3D path of the hand or of each hand of the model of the user's body structure in the user animation. In some embodiments, the target movement may be defined by a 3D start position and/or a 3D end position of the hand or of each hand of the model of the user's body structure in the user animation.

The target movement may be defined by a start position, an end position and/or a plurality of positions defining a path of the part of the user's body associated with the user interface, which in the example embodiment is the position of the hands for a handle user interface.

Figure 11:
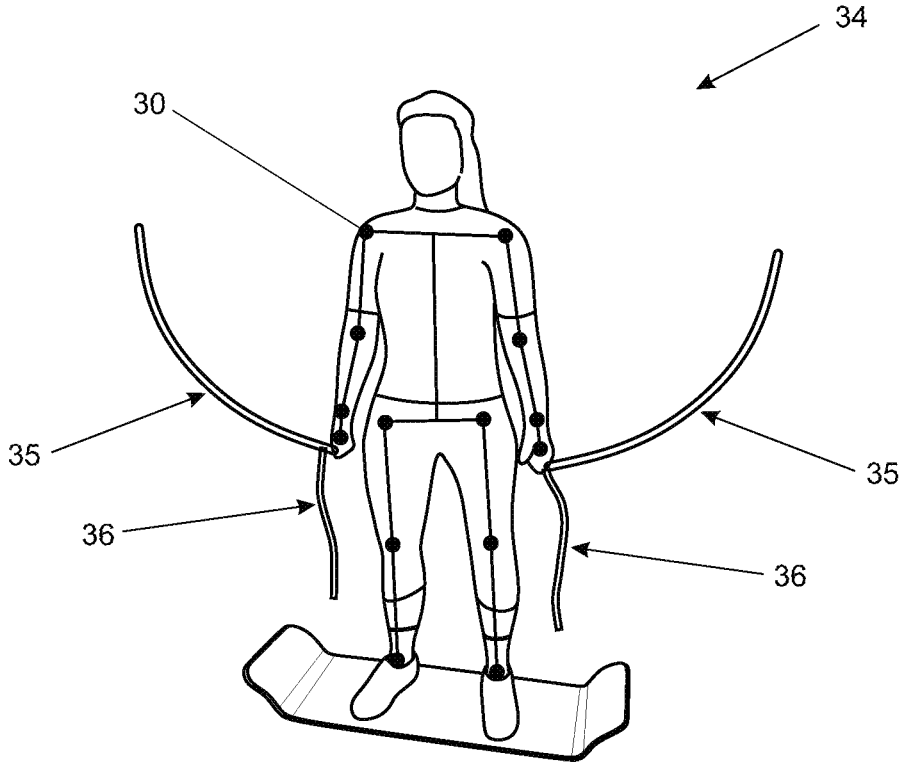
FIG. 11 illustrates a frame of a user animation, showing a model of a user's body structure in a standing position, and target movements generated by movement of the user's body structure in the animation.

FIG. 11 shows a frame from an example user animation 34, with a model of the user's body structure 30 in a standing position and 3D paths 35, 36 for the handles/user interface 4 or the user's hand positions for two different exercises. Target movement 35 corresponds with the exercise of shoulder flies. Target movement 36 corresponds with the exercise of squats.

The controller is further configured to monitor the position of the user (the user's hand(s)) during use by tracking the position of the user interface/handle(s) 4 during use, to provide an indication of the user's actual movement during use. Preferably the controller is configured to monitor the user's actual movement real time. For example, the controller may be configured to determine the user's actual movement based on the position of the handles many times per second. Additional sensor data, such as the output of load cells positioned on the deck, may be used to provide supplementary information relating to the user's actual movement during use by indicating the user's position on the deck and the distribution of the user's weight between left and right feet and/or in a forwards and backwards direction.

As described above, the controller is configured to provide feedback to the user based on the comparison between the target movement and the user's actual movement during use. For example, the controller makes a comparison between the 3D position of the handles during use and the hand position of the target movement (e.g. movements 35 and 36 in FIG. 11) for the exercise being performed. In some embodiments, the target movement may be a 3D path and the controller may compare the 3D path of the user's actual movement with the target movement or may compare start and end positions of the actual movement with start and end positions of the target movement. The target movement may be start and end positions for an exercise and the controller may compare the start and end points of the user's actual movement with the target movement, for example to provide a range of motion comparison. Such a comparison may be made without a comparison of the movement in between the start and end positions of the movement.

In some embodiments, where the user's actual movement deviates from the target movement by a predetermined distance (threshold), the controller causes feedback to the user to instruct the user to correct the user's movement. The controller may issue further feedback, such as an indication that the user is performing the exercise correctly, or instructions to make further adjustments until the user has achieved the target movement. A user may achieve a target movement once the user's actual movement is within a distance threshold of the target movement. Feedback may be provided where the user performs or fails to perform a full range of motion based on the start and end positions of the movement.

Other types of feedback may be provided, for example based on pace of exercise. Feedback may be motivational. The controller may be configured to select or suggest exercise type and/or exercise level (for example weight level) based on a comparison between the user's actual movement and the target movement. Feedback may also be provided in relation to the speed or pace of exercising, for example if the user is performing an exercise too quickly or too slowly. The controller may be configured to detect fatigue, for example where the user fails to complete a full range of motion or the user's pace decreases. Feedback may include instructing the user to stop, or to reduce the level of exercise. Speed or pace feedback may be based on the handle position or may be based on motor/spool position.

In some embodiments, the controller is configured to control the device based on the comparison between the target movement and the user's actual movement during use. For example, where the user's actual movement deviates from the target movement, the controller may cause the resistance load to be reduced or increased in order to assist the user to achieve the target movement. As a further example, where the controller detects fatigue (in the manner described in the preceding paragraph) the controller may cause the resistance load to be reduced or released entirely.

In the above example the controller is configured to determine a target movement for the user's hand, since the position of the user's hand is provided by the calculated position of the handle during use based on output from the one or more sensors. However, in some embodiments, the controller may additionally or alternatively determine a target movement for one or more joints of the user's body structure, such as the user's knee, hips, shoulder, elbows and wrist joints. The positions of the user's joints may be derived from the user's body structure, and the controller may be configured to track the 3D position of one or more joints of the model of the user's body structure in the user animation. During use, the position of one or more of the user's joints may be calculated based on the handle position/position of the user interface and the user's body structure, to provide an indication/estimation of the actual position of the user's joint(s) for comparison to the target movement derived from the user animation.

For any given exercise or movement there may be one or more target movements. There may be a target movement associated with the user interface, and/or a target movement of a joint of the user's body. For example, a bicep curl or shoulder fly may be defined by two target movements, a target movement for the user's hand and a target movement for the user's elbow. The controller may compare the actual movement of the hand/user interface with the target movement for the hand/user interface, and additionally compare a calculated actual movement for the elbow and a target movement for the elbow.

Where there are two or more target movements, the controller may provide feedback based on deviation of the user's actual movement from one or more of the target movements.

In yet further embodiments the user interface may not be a handle and may engage with the user elsewhere on the user's body (such as a stirrup to engage a user's foot and/or a belt which engages at the user's waist/hips and attaches to the cable). In such embodiments the determination of a user specific target movement and comparison with the actual movement of the user can occur in the same manner as previously described, except that the position of one or more of the user's joints may be calculated based on the position of the user's knee, waist, hip, shoulder, elbow or wrist (depending on where the user interface engages) rather than referencing to the position of the user's hand.

The calibration movements provided by the library of 3D animations of the reference body structure is predetermined and provided by the equipment manufacturer or provider of exercise programs. The controller automatically generates the user animation for each exercise based on the calibration movement and the user's body structure, determines the target movement(s) from the user animation, and compares the user's movement with the target movement(s) preferably real time for each exercise being performed.

The present invention determines a user specific body structure, and a user specific target movement based on the user specific body structure for each exercise to be performed when using the device. The invention therefore provides a benefit whereby user specific feedback can be provided to the user based on how the user performs exercises when using the device. Furthermore, the user's body structure may be determined only once in order to generate target movements for a plurality of exercises. It is not necessary for the user to perform a calibration movement for each exercise to be performed. Once the user's body structure has been determined, no further calibration by the user is necessary. The user's body structure may only be determined once for each individual user, at the beginning of an exercise session, or once for the lifetime of using the device. For example, the user may enter a code (such as a name) into the device so that the user's body structure may be recalled each time the user uses the device.

In the preferred embodiment, the calibration routine to determine the user's body structure is based on the position of the handles or other user interface in at least one calibration position. This means the body structure is determined without the requirement for expensive camera technology and complex human pose estimation imaging processing software. This provides for the benefits of user specific feedback provided by a low-cost exercise device. Furthermore, the use of the handle/user interface position in the estimation of the user's body structure provides for a compact unit that allows for the unit to be easily transported and requiring little to no set up. The device may include audio feedback only, so that the requirement for one or more display screens for providing visual feedback to the user is avoided, to further achieve a low-cost exercise device. This configuration of the device makes for a compact device that is easily transportable, for example in the trunk of a motorcar.

In some embodiments, the controller may be configured to determine an exercise being performed by the user based on an actual movement of the user during use. For example, during use the user may choose to perform any exercise from a plurality of possible exercises such as bicep curls, squats, overhead press, flies etc, and the controller determines which exercise from the plurality of exercises the user is performing. The controller monitors/tracks the handle/user interface during use to determine the user's actual movement during use.

The controller may monitor the user's actual movement of the handles/user interface and compare this to a plurality of target movements. Based on the comparison of the actual movement with the plurality of target movements the controller determines which exercise the user is performing.

For example, the actual movement is determined to be the same as a target movement where the user's actual movement is within a distance threshold of the target movement. Once the controller determines the actual movement is the same as a target movement, the controller determines the exercise being performed as the exercise that corresponds to that target movement.

In this way, the user may simply use the device without selecting or entering into the device (e.g. via a HMI) a particular exercise to perform. The device is configured to automatically determine which exercise is being performed.

Once the controller determines which exercise is being performed, the controller can then continue to compare the user's actual movement with the target movement in order to determine and provide feedback to the user as described earlier. The threshold to determine which exercise is being performed may be broader than a threshold used to determine if the user is performing a particular movement or exercise correctly.

Variations

The above described embodiments are provided by way of example. In some embodiments, the controller may be configured to determine the user's body structure based on one or more body dimensions entered by the user or other persons, such as a personal trainer. User dimensions may include user height and/or arm length or may include one or more of the user dimensions as described above. The user's body structure may be estimated based on a single body dimension only, such as user height, and scaling based on a reference body structure to determine the relative positions of the hands and one or more joints. Where a plurality of body dimensions is provided, the user's body structure may be determined from the user's body dimensions without scaling based on a reference body structure.

In another embodiment, the target movement may be estimated based on one or more user specific body dimensions, such as user height, and scaling based on a reference body structure to determine the relative positions of the hands/user interface.

In some embodiments, the user's body structure may be determined through the use of camera technology such as the Azure Kinect™ camera and pose estimation imaging processing software. In such an embodiment, the controller may be configured to determine, for each target movement, a start position, end position and/or positions defining a 3D path for one or more joints of the 3D model of the user's body structure, for example the user's knees, hips, shoulder, elbows and wrist joints. The position of the user's hands and/or one or more joints may be tracked by the use of camera technology and pose estimation imaging processing software. Feedback may be provided based on a comparison between the movement of one or more of the user's joints and the target movement for the or each joint. For example, the user may be performing squats, and the controller may determine that the user's knee joints are not in a correct position relative to the user's hip joints. The controller may cause feedback to instruct the user to move his or her knees to a different position to perform the squat exercise correctly.

The target movement may be determined from the user's body structure without reference to a calibration movement. For example, a target position of the user's hand during use (e.g. a start and end position for an exercise), may be estimated based on the user's body structure without calibration from a calibration reference. For example, a target position for the user's hands at the start, end and/or during an exercise movement may be estimated from the user's height and a reference body structure.

The present invention has been described herein with reference to an exercise device comprising an electrically powered resistance mechanism (electric motor and spool). One skilled in the art will appreciate the invention may be used in any exercise device comprising a user interface, such as a handle, coupled to a resistance mechanism, including traditional weightlifting devices comprising a stack of metal plates. In the described embodiments, the user interface is coupled to the resistance mechanism via a cable, however other connection arrangements between the user interface and the resistance mechanism may be possible, such as linkages and/or levers, including rigid connections.

The present invention may also be embodied in a device for providing a method for providing feedback to a user during exercising. The present invention may provide a feedback or training device for at least providing feedback to a user during exercise, for example when exercising with or without free weights such as traditional dumbbells. In such an embodiment, the exercise feedback device may comprise a camera for monitoring a user and providing feedback to the user based on a user specific target movement determined from the user specific body structure. Alternatively, a user may use traditional free weights such as dumbbells or a barbell with a connection (e.g. cable) between the weight and a zero resistance mechanism including one or more sensors configured to detect movement of the user. The zero resistance mechanism may comprise a motor and spool where the motor is controlled to provide zero resistance.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

The invention claimed is:

1. A personal exercise device comprising:

a user interface to be moved by a user in a 3-dimensional space when using the device; a resistance mechanism to generate a force;

a cable coupled between the user interface and the resistance mechanism to transmit the force from the resistance mechanism to the user interface;

one or more sensors configured to detect movement of the user in the 3-dimensional space when using the device;

a feedback device; and a controller in communication with the one or more sensors, the controller configured to:

estimate a user specific body structure for the user;

determine a user specific target movement for the user based on the user's body structure;

determine an actual movement of the user when using the device to perform an exercise based on one or more outputs from the one or more sensors; and provide feedback to the user via the feedback device based on a comparison between the user's actual movement and the user specific target movement.

2. The device as claimed in claim 1, wherein the controller is configured to determine a plurality of user specific target movements based on the estimated user's body structure, wherein each target movement corresponds to one exercise of a plurality of exercises to be performed when using the device.

3. The device as claimed in claim 1, wherein the controller is configured to estimate the user's body structure based on one or more user specific body dimensions.

4. The device as claimed in claim 3, wherein the controller is configured to estimate the user's body structure based on the one or more user specific body dimensions and a predetermined reference body structure, optionally by scaling one or more body dimensions of the reference body structure based on the one or more user's body dimensions.

5. The device as claimed in claim 4, wherein the device comprises a memory in communication with the controller for storing a plurality of reference body structures, and the controller is configured to select the reference body structure from the plurality of reference body structures based on user inputs.

6. The device as claimed in claim 3, wherein the one or more sensors is configured to provide one or more outputs upon which a position of the user interface in the 3-dimensional space can be determined, and the controller is configured to:

provide a calibration routine to determine the one or more user specific body dimensions, in the calibration routine the controller configured to:

instruct the user to hold the user interface in at least one calibration position; determine the at least one calibration position based on the one or more outputs from the one or more sensors; and estimate the one or more user specific body dimensions based on the at least one calibration position.

7. The device as claimed in claim 6, wherein in the calibration routine the controller is configured to:

instruct the user to hold the user interface in a plurality of calibration positions, and with the user interface in each calibration position, determine the calibration position based on the one or more outputs from the one or more sensors; and estimate the one or more user specific body dimensions based on the plurality of calibration positions.

8. The device as claimed in claim 1, wherein the controller is configured to determine the target movement based on the user's body structure and a predetermined calibration movement.

9. The device as claimed in claim 8, wherein the device comprises a memory in communication with the controller, the memory storing a plurality of predetermined calibration movements corresponding to a plurality of exercises that may be performed when using the device.

10. The device as claimed in claim 8, wherein each calibration movement is, or is defined by a reference animation, wherein the reference animation is a 3D digital animation of a model of the reference body structure performing a desired exercise.

11. The device as claimed in claim 10, wherein the controller is configured to:

generate a user animation based on the reference animation and the user's body structure, wherein the user animation is a 3D digital animation of a model of the user's body structure; and determine the target movement from the user animation.

12. The device as claimed in claim 1, wherein the actual movement of the user is either or both of the following:

a) a movement of the user's hand or hands b) a movement of one or more joints of the user's body.

13. The device as claimed in claim 1, wherein the target movement comprises either or both of:

a) a plurality of 3D positions defining a 3D path for the hand or for each hand of the user, and/or a 3D start position and/or a 3D end position for the hand or for each hand of the user, and b) a plurality of 3D positions defining a 3D path or 3D paths for one or more of the user's body joints, and/or a 3D start position and/or a 3D end position for one or more of the user's body joints.

14. The device as claimed in claim 1, wherein the one or more sensors is configured to provide one or more outputs upon which a position of the user interface in the 3-dimensional space can be determined; and wherein the controller is configured to:

determine the position of the user interface during use based on the one or more outputs from the one or more sensors;

determine the actual movement of the user based on the position of the user interface as the user moves the user interface when using the device to perform an exercise, and optionally wherein the user interface is a handle to be held by the user's hand during use.

15. The device as claimed in claim 14, wherein the position of the user interface is indicative of an actual position of the user's hand or other associated part of the user's body when using the device to perform an exercise.

16. The device as claimed in claim 14, wherein the controller is configured to determine an actual position of one or more joints of the user's body during use based on the one or more outputs from the one or more sensors.

17. The device as claimed in claim 1, wherein the device comprises one or more load cells in communication with the controller to detect the user's weight, and the controller is configured to determine the user's weight based on one or more outputs from the one or more load cells and estimate the user's body structure based on the user's weight.

18. The device of claim 1, wherein the feedback includes instructions to the user to alter the user's movement when the user's actual movement deviates from the target movement by a predetermined distance.

19. The device of claim 1, wherein the feedback device is an audio feedback device, and optionally wherein the exercise device provides only audio feedback to the user.

20. The device as claimed in claim 1, wherein the resistance mechanism comprises an electric motor in communication with the controller and a spool rotationally driven by the motor, and wherein the cable is coupled to the spool; and wherein the controller is configured to operate the motor to generate the force.

21. The device as claimed in claim 1, wherein the sensors comprise one or more load cells in communication with the controller to detect movement of the user in 3-dimensional space by detecting distribution of the user's weight, and wherein the controller is configured to determine the actual movement of the user based on one or more outputs from the one or more load cells.

* * * * *